United States Patent [19]

Luttenberger et al.

[11] Patent Number: 4,738,310

[45] Date of Patent: Apr. 19, 1988

[54] HEAT EXCHANGER

[75] Inventors: David B. Luttenberger; James R. Shook, both of Toledo, Ohio

[73] Assignee: United McGill Corporation, Groveport, Ohio

[21] Appl. No.: 769,602

[22] Filed: Aug. 26, 1985

[51] Int. Cl.[4] ..... F28F 9/06; F28F 21/00

[52] U.S. Cl. ..... 165/158; 165/162; 165/173; 165/133; 165/145; 165/72; 165/905; 285/162; 285/911

[58] Field of Search ..... 165/158, 173, 145, 905, 165/162; 285/162, 911

[56] References Cited

U.S. PATENT DOCUMENTS

| | | | |
|---|---|---|---|
| 3,327,777 | 6/1967 | Kovalik et al. | 165/158 |
| 3,332,479 | 7/1967 | Martin, Jr. | 165/158 |
| 4,365,829 | 12/1982 | Fowler | 285/162 |

FOREIGN PATENT DOCUMENTS

| | | | |
|---|---|---|---|
| 148394 | 9/1983 | Japan | 165/173 |

*Primary Examiner*—Albert W. Davis, Jr.
*Attorney, Agent, or Firm*—Mueller and Smith

[57] ABSTRACT

A glass tube heat exchanger including a sealing sleeve comprising at least one hydraulic sealing section, an intermediate sealing section and an interior sealing section is disclosed. The hydraulic sealing section has a triangular cross section including one obtuse angle formed by two legs, one of which extends radially outwardly from the longitudinal axis of the seal. The intermediate sealing section comprises a generally cylindrical shaped body and at least one, and preferably two, toroidal belts. The interior sealing section comprises a lip adapted to seal tightly against the glass tube and a flange adapted to seal against the tube sheet. Preferably, the interior sealing section is a mirror image of the hydraulic sealing section. According to another aspect of the instant invention, the glass tube heat exchanger is provided with two box headers including pass partitions operable to cause a fluid entering one of the box headers, after flowing through one layer of glass tubes in a first direction, to flow through the next layer of glass tubes in a second direction which is opposite the first direction and so on so that the direction of flow of the fluid is reversed through successive layers of glass tubes.

15 Claims, 4 Drawing Sheets

HEAT EXCHANGER

BACKGROUND OF THE INVENTION

1. Field of the Invention

The instant invention relates to heat exchangers and, more specifically, to glass tube heat exchangers comprising a plurality of glass tubes in substantially parallel relationship and mounted, at their ends, in apertures provided in tube sheets. The invention is particularly concerned with such heat exchangers which further comprise box headers.

2. Description of the Prior Art

U.S. Pat. No. 4,117,884 discloses a glass tube heat exchanger comprising a parallel array of glass tubes mounted, at their ends, in a cast resin or plastic. According to the reference, the conventional tube sheet is obviated by the cast resin or plastic.

U.S. Pat. No. 4,295,522 discloses a glass tube heat exchanger comprising a parallel array of glass tubes mounted in a tube sheet provided with apertures which are larger than the cross-sectional area of the tubes. The tubes are sealed in the tube sheet by a liquid casting resin which, by capillary action, enters the annular gaps between the edges of the tube sheet apertures and the tubes. U.S. Pat. No. 4,224,982 discloses a similar glass tube heat exchanger which additionally includes a protective tube sheet composed of an acid-resistant and heat-resistant material.

U.S. Pat. No. 4,159,035 discloses a tube and tube sheet seal. According to the reference, a resilient sheet is placed on one side of the tube sheet and a tube is used to force a portion of the resilient sheet through an aperture in the tube sheet whereby a portion of the resilient sheet covers the end of the tube. That portion is cut thereby allowing the resilient sheet to contract and form a flange around the outside of the tube.

U.S. Pat. No. 4,317,483 discloses a glass tube heat exchanger and a composite tube and tube sheet seal. The tube sheet is provided with openings having a diameter larger than the exterior diameter of the tubes mounted therein. The seal comprises, on either side of the medial plane of the tube sheet, lips which bear resiliently and substantially tightly against the outer wall of the tube passing through the opening while retaining the tube some distance away from the edges of the opening. In one embodiment, a sleeve is disposed between the tube and the edges of the opening in the tube sheet and rings provided with the lips are screwed onto the sleeve on each side of the tube sheet.

U.S. Pat. No. 3,559,730 discloses a glass tube heat exchanger and, specifically, a seal for securing a glass tube in a tube sheet. According to the reference, interposed between the end of each tube and a tube sheet aperture, there is disposed a "sealing sleeve having at least one and preferably two external sealing zones adapted to seal against the edges of the aperture and at least one external sealing zone adapted to seal against the tube."

None of the prior art references discussed above and, indeed, no prior art of which the applicants are aware, discloses a glass tube heat exchanger, including box headers, which is operable to circulate a liquid through the glass tubes. This is understandable because the prior art does not disclose a tube to tube sheet seal which is capable of withstanding the fluid pressure associated with a liquid-to-fluid glass tube heat exchanger comprising box headers.

Known are liquid-to-fluid glass tube heat exchangers comprising generally U-shaped tube bends. The tube bend is operable to circulate a liquid from one tube to another tube. The use of tube bends, however, necessitates a wide separation between individual tubes so that the tube bends can be installed on the tubes. Box headers obviate tube bends in liquid-to-fluid glass tube heat exchangers. In addition, the use of box headers allows for much smaller tube separation thereby increasing the overall efficiency of heat exchangers incorporating box headers.

SUMMARY OF THE INSTANT INVENTION

The instant invention is based upon the discovery of a glass tube heat exchanger including a sealing sleeve which is operable to seal a glass tube in a tube sheet. The instant invention is further based upon the discovery that the seal effected by the sealing sleeve can withstand pressures up to approximately 75 psi thereby allowing the use of box headers in conjunction with a glass tube heat exchanger. The glass tube heat exchanger incorporating the sealing sleeve according to the instant invention, when used in conjunction with a box header, exhibits drastically improved heat transfer characteristics by comparison with prior art gas-to-gas glass tube heat exchangers.

A glass tube heat exchanger, according to the instant invention, includes a sealing sleeve comprising at least one hydraulic sealing section, an intermediate sealing section and an interior sealing section. The hydraulic sealing section has a triangular cross section including one obtuse angle formed by two legs, one of which extends radially outwardly from the longitudinal axis of the seal. The intermediate sealing section comprises a generally cylindrical shaped body and at least one, and preferably two, toroidal belts. The interior sealing section comprises a lip adapted to seal tightly against the glass tube and a flange adapted to seal against the tube sheet. Preferably, the interior sealing section is a mirror image of the hydraulic sealing section.

The glass tube heat exchanger, according to the instant invention, is preferably provided with two box headers including pass partitions operable to cause a fluid entering one of the box headers after flowing through one layer of glass tubes in a first direction to flow through the next layer of glass tubes in a second direction which is opposite the first direction and so on so that the direction of flow of the fluid is reversed through successive layers of glass tubes. Consequently, the heat transfer characteristics of a glass tube heat exchanger according to the instant invention are significantly better than those of prior art glass tube heat exchangers. Furthermore, the use of box headers obviates individual tube bends and permits a much narrower separation between individual tubes than can be achieved in conjunction with tube bends thereby further improving the heat transfer characteristics of heat exchangers according to the invention.

The foregoing characteristics of glass tube heat exchangers according to the instant invention make them well suited for use as boiler water preheaters. In this application, flue gases are passed through the heat exchanger and over the exterior surfaces of the glass tubes therein. Water is circulated through the box headers and the glass tubes where it absorbs heat from the flue gas. According to a preferred embodiment, the portion of the heat exchanger which is contacted by the flue gas is composed solely of materials which are corrosion resistant. This type of heat exchanger is an effective flue gas conditioner and operable to cool sulfur-containing flue gases to a temperature below the dew point of sulfuric acid. The flue gases are then ready to be passed through one or more scrubbers operable to remove the sulfur compounds.

Accordingly, it is an object of the instant invention to provide an improved tube-to-tube sheet seal in a tubular heat exchanger.

It is a further object of the instant invention to provide a glass tube heat exchanger with box headers having pass partitions.

It is another object of the instant invention to provide a glass tube heat exchanger with heat transfer characteristics which are substantially better than those of prior art glass tube heat exchangers.

What follows is a detailed description of the best mode known to the instant inventors for practicing the subject invention. It will be apparent, however, to those skilled in the art that the instant invention is subject to enumerable variations. Accordingly, the following disclosure is intended to enable one skilled in the art to practice the instant invention rather than as limiting it. Indeed, the instant invention is limited only by the scope of the appended claims.

DESCRIPTION OF THE PREFERRED EMBODIMENT

Figure 1:
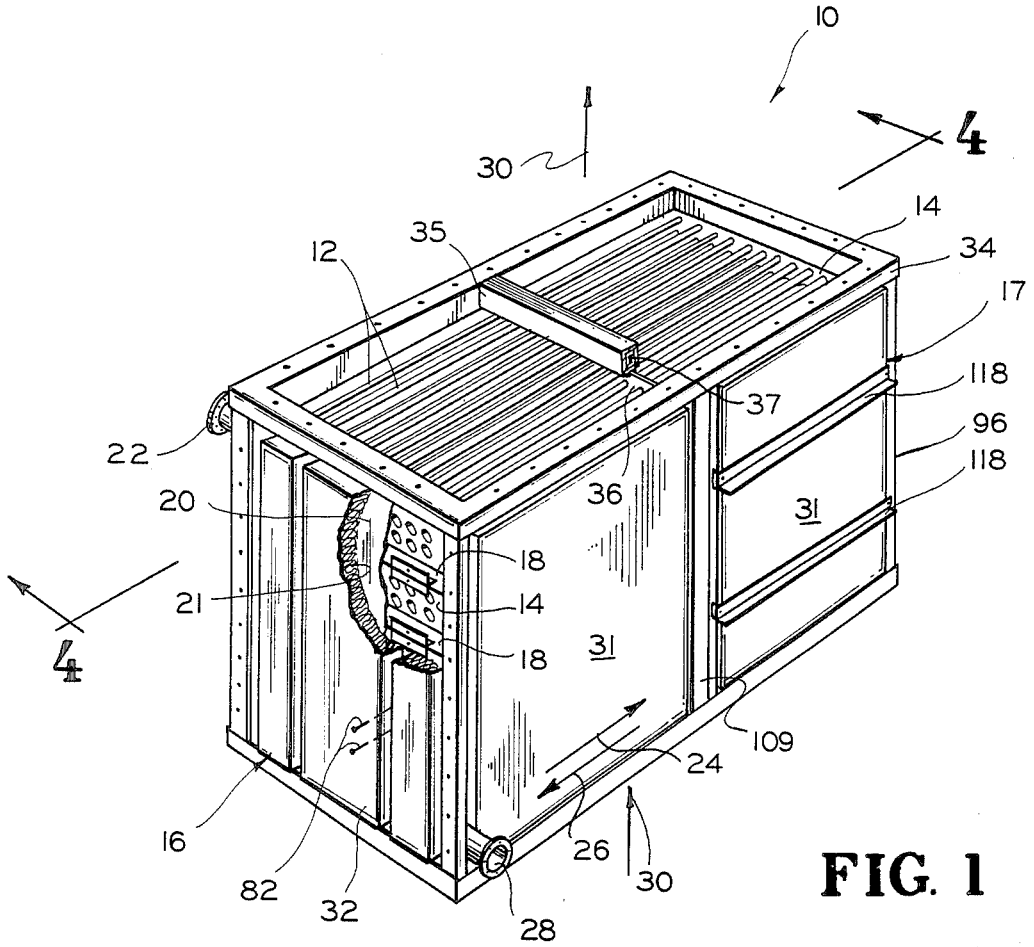
FIG. 1 is a perspective, partially cut-away view of a heat exchanger according to the instant invention.

With reference to FIG. 1, a tubular heat exchanger according to the instant invention is indicated generally at 10. Disposed within the heat exchanger 10 are a plurality of tubes 12 arranged in a substantially parallel array. According to the invention, the tubes 12 are composed of glass and, preferably, a borosilicate glass. The tubes 12 are mounted, at their ends, in apertures provided in tube sheets 14. Details of the manner in which the tubes are mounted in apertures in the tube sheets 14 are discussed subsequently in connection with FIGS. 2 and 3.

On the exterior sides of the tube sheets 14, the heat exchanger 10 is provided with two box headers indicated generally at 16 and 17. The box header 16 comprises a plurality of chambers defined by the tube sheet 14, pass partitions 18 and a door 20. The pass partitions 18 provided in the box header 16 are staggered relative to the pass partitions 18 (FIG. 4) in box header 17. Thus, a heat transfer fluid entering the box header 16 via an inlet 22 travels through the uppermost layer of tubes 12 in the direction of the arrow 24. Upon reaching the opposed box header 17, the heat transfer fluid returns to the box header 16 traveling in the direction of arrow 26 through the next lower layer of glass tubes 12. The heat transfer fluid continues zigzagging through the heat exchanger 10 and eventually exits it via an outlet 28. A second heat transfer fluid flows through the interior of the heat exchanger 10 in contact with the exterior of the glass tubes 12 and in the direction indicated by the arrows 30. This mode of operation is discussed further in connection with FIG. 4.

The sides of the heat exchanger 10 comprise side panels 31 and the doors 20 of the heat exchanger 10 are covered with end panels 32, both of which contain insulation 21. The side panels 31 are secured to a frame comprising vertical frame members 96 and 109 by side panel support bars 118. On a support member 35 there is mounted an intermediate tube sheet 36, preferably composed of fiber glass. The tube sheet 36 supports the tubes 12 at a point intermediate the box headers 16 and 17. The support member 35 is preferably composed of fiber glass overlayed on a steel tube 37. Preferably, the tubes 12 are supported, by a tube sheet 14 or an intermediate tube sheet 36, at intervals not exceeding four feet. The construction details of the side panels 31 and end panels 32 and the frame comprising vertical frame members 96 and 109 are discussed subsequently.

Figure 2:
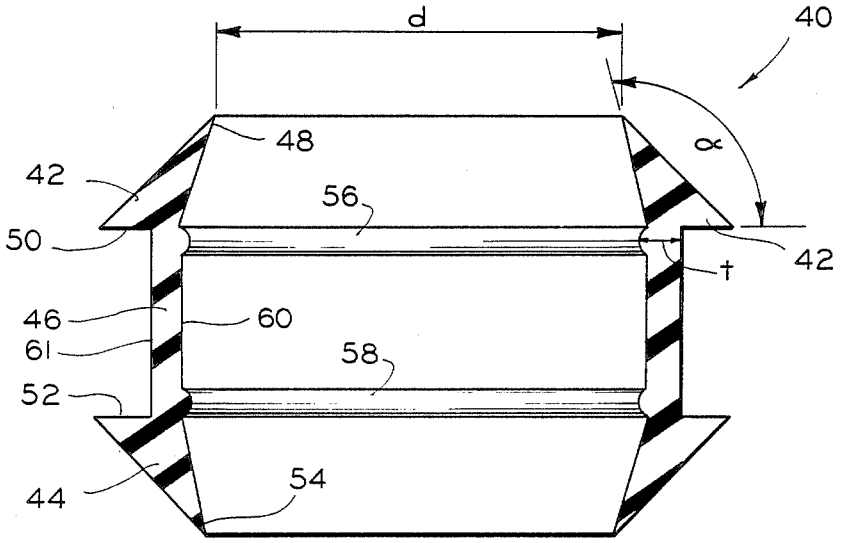
FIG. 2 is a cross-sectional view of one embodiment of a sealing sleeve in accordance with the instant invention.

Referring now to FIG. 2, a sealing sleeve according to the instant invention, shown in cross section, is indicated generally at 40. The sealing sleeve 40 comprises a hydraulic sealing section 42, an interior sealing section 44 and an intermediate sealing section 46 therebetween. The hydraulic sealing section 42 comprises a tube sealing surface 48 and a tube sheet sealing surface 50. The smallest interior diameter of the hydraulic sealing section 42 is designated d. Preferably, the interior sealing section 44 similarly comprises a tube sheet sealing surface 52 and a tube sealing surface 54. As shown in FIG. 2, the cross section of the hydraulic sealing section 42 is a triangle wherein the tube sealing surface 48 constitutes one side and the tube sheet sealing surface 50 constitutes a second side. These sides of the triangle form an angle alpha which, according to the instant invention, is obtuse, i.e., greater than 90°.

The intermediate sealing section 46 extends from the tube sheet sealing section 50 of the hydraulic sealing section 42 to the tube sheet sealing surface 52 of the interior sealing section 44. Preferably, the longitudinal length of the intermediate sealing section 46 is equal to or slightly less than the thickness of a tube sheet in which it is mounted. The intermediate sealing section 46 further comprises a first toroidal belt 56 and a second toroidal belt 58. The wall of the intermediate sealing section 46, through the toroidal belt 56, has a thickness t. As shown in FIG. 2, the toroidal belts 56 and 58 are preferably positioned at the longitudinal extremes of the intermediate sealing section 46 and on an interior surface 60 which is opposite an exterior surface 61 thereof.

The sealing sleeve 40 is preferably composed of a resilient, corrosion-resistant material. The preferred material is an elastomer commercially available under the trademark "Viton" from DuPont de Nemours Corporation. Viton rubber exhibits excellent resistance to degradation in high temperature environments. In addition, it can withstand the severe corrosive effects of sulfuric acid which is invariably precipitated out of flue gases produced by the combustion of fossil fuel when such gases are cooled. Furthermore, Viton rubber is very resilient. Other materials exhibiting properties similar to those of Viton rubber may be substituted therefor. For example, polymerized polytetrafluoroethylene, commonly referred to by the trademark "Teflon", is a suitable substitute for Viton rubber.

Figure 3:
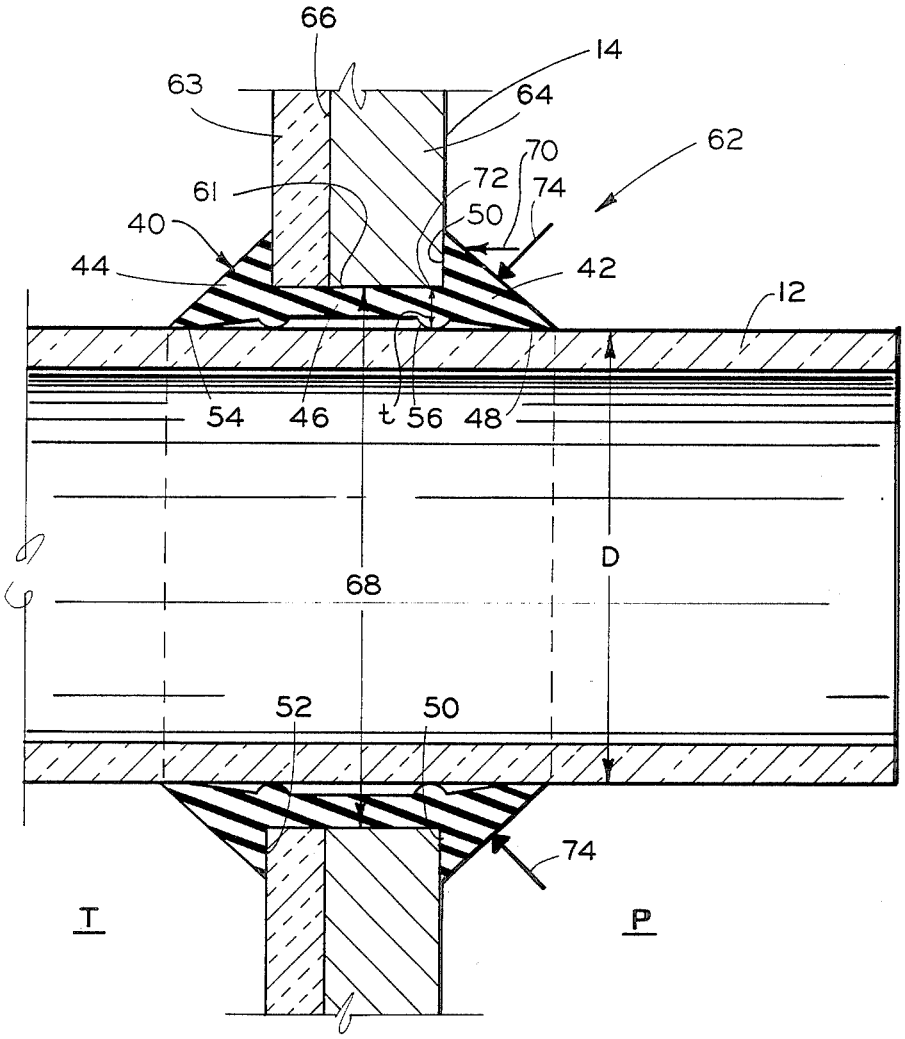
FIG. 3 is a cross-sectional view of a tube-to-tube sheet seal incorporating the sealing sleeve shown in FIG. 2.

FIG. 3 depicts a tube 12 to tube sheet 14 seal indicated generally at 62 and incorporating the sealing sleeve 40. The tube sheet 14 is preferably a composite plate comprising a plate 63 composed of a corrosion resistant material and a plate 64, preferably composed of stainless steel. The preferred material for the plate 63 is fiber glass because of its corrosion-resistant properties. The plates 63 and 64 can be held together by tube sheet sealing surfaces 50 and 52 of the sealing sleeve. Between the plates 63 and 64, there is preferably provided a thin layer 66 of corrosion resistant material such as Viton which provides additional corrosion protection for the plate 64.

Extending through an aperture 68 in the tube sheet 14 is a glass tube 12. Interposed between the wall of the aperture 68 and the exterior of the glass tube 12 is a sealing sleeve 40 of the type depicted in FIG. 2. The tube sealing surface 48 of the hydraulic sealing section 42 bears tightly against the exterior surface of the glass tube 12. As shown in FIG. 3, tube sealing surface 48 is displaced radially outwardly from its position in FIG. 2 where the sealing sleeve 40 is in an unflexed condition. This displacement is caused by the presence of the glass tube 12 in the sealing sleeve 40. The glass tube 12 has an exterior diameter D greater than the smallest internal diameter d (FIG. 2) of the hydraulic sealing section 42. The displacement of the tube sealing surface 48 causes a corresponding displacement of the tube sheet sealing surface 50 of the hydraulic sealing section 42. The displacement of the tube sheet sealing surface 50 is in the direction of arrow 70, i.e., towards the tube sheet 14. Consequently, the tube sheet sealing surface 50 bears tightly against the tube sheet 14.

Toroidal belt 56 of the intermediate sealing section 46 bears tightly against the exterior surface of the glass tube 12. A portion 72 of the exterior surface 61 of the intermediate sealing section 46 bears tightly against the surface of the aperture 68 in the tube seat 14. The portion 72 of the surface 61 is positioned radially outwardly of the toroidal belt 56. This is due to the fact that the dimension of thickness t of the intermediate sealing section 46 through toroidal belt 56 is greater than the difference between the diameter of the aperture 68 in the tube sheet 14 and the exterior diameter D of the glass tube 12. Consequently, the exterior surface of the glass tube 12 exerts axial pressure through the toroidal belt 56, through the intermediate sealing section 46 and through the sealing surface 72 to the edge of the aperture 68 in the tube sheet 14.

According to the invention, the hydraulic sealing section 42 of the sealing sleeve 40 is positioned adjacent to plate 64 of the tube sheet 14. In a glass tube heat exchanger provided with box headers in accordance with the instant invention, the plate 64 and the hydraulic sealing section 42 would be positioned on the box header side of the tube sheet 14. The box header side is labeled P for pressure in FIG. 3. The other side of the tube sheet 14 is labeled T for transfer of heat. During operation of a glass tube heat exchanger, the T side of the tube sheet 14 is subjected to pressure at or near atmospheric pressure. In contrast, when water is circulated through box headers on the P side of the tube sheet 14, pressures in excess of 50 psi can be developed. The hydraulic sealing section 42 can withstand, without leaking, pressures in excess of 75 psi. Preferably, the interior sealing section 44 is symmetric with the hydraulic sealing section 42 about the medial plane of the tube sheet 14. In this instance, the sealing pressure exerted by tube sheet sealing surfaces 50 and 52 place the plates 63 and 64 in compression providing structural integrity to the tube sheet 14. However, since the second sealing section 44 need not exhibit the integrity under hydraulic pressure required of the hydraulic sealing section 42, the second sealing section 44 may have one of a variety of configurations including configurations not specifically disclosed herein.

When hydraulic pressure is exerted against the hydraulic sealing section 42 of the sealing sleeve 40, generally in the direction of arrow 74, the tube sealing surface 48 is pressed tightly thereby against the exterior of the glass tube 12. Similarly, such hydraulic pressure presses the tube sheet sealing surface 50 tightly against the tube sheet 14. As the pressure on the P side of the tube sheet 14 increases, so does the sealing pressure of tube sealing surface 48 and tube sheet sealing surface 50 against the glass tube 12 and the tube sheet 14, respectively. Therefore, the sealing sleeve 40 comprising the hydraulic sealing section 42 and the intermediate sealing section 46 including toroidal belt 56 can withstand the high pressures developed in a box header in which a liquid is circulated.

Figure 4:
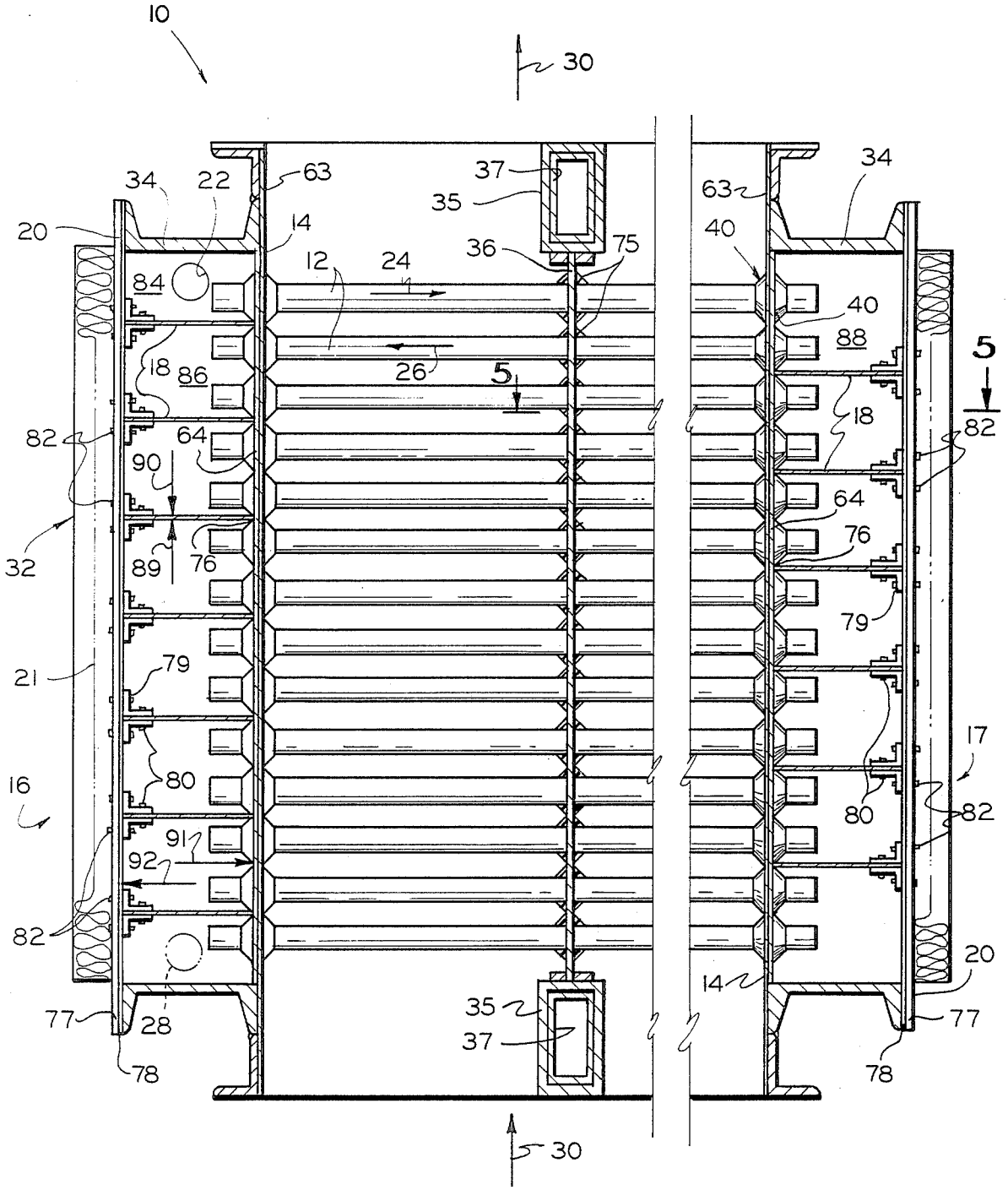
FIG. 4 is a cross-sectional view of a heat exchanger according to the instant invention, the cross section being taken along line 4—4 in FIG. 1.

FIG. 4 is a cross section of a heat exchanger 10 taken along the line 4—4 of FIG. 1. A plurality of glass tubes 12 are mounted, at their ends, in tube sheets 14 by sealing sleeves 40. The tubes 12 are supported at an intermediate point by sleeves 75 in an intermediate tube sheet 36. The tube sheet 36 is supported by support members 35 comprising fiber glass overlayed on steel tubes 37.

Figure 5:
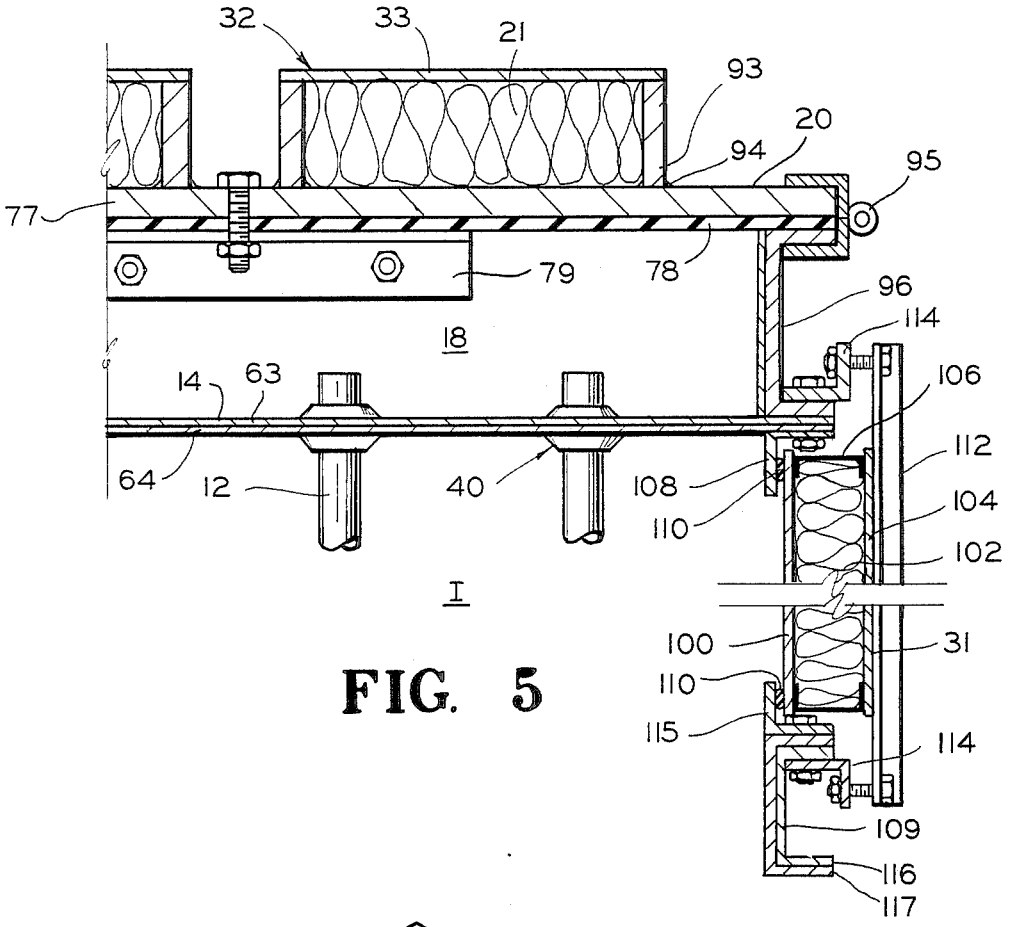
FIG. 5 is a cross-sectional view of a box header taken along the line 5—5 in FIG. 4.

A box header 16 comprises a fluid inlet 22, pass partitions 18, a door 20, a tube sheet 14, and a fluid outlet 28. An opposed box header 17 similarly comprises pass partitions 18, a door 20 and a tube sheet 14 but is not provided with a fluid inlet 22 or a fluid outlet 28. One end of each pass partition 18 is welded, as at 76, to a plate 64 of each of the two tube sheets 14. Each door 20 comprises a steel plate 77 and a resilient sheet 78, preferably composed of neoprene rubber. The other end of each pass partition 18 is rigidly secured to one of the doors 20 by angle irons 79. Two angle irons 79 are fastened to each pass partition 18, as by fasteners 80. Each angle iron 79 is also fastened to the door 20 as by fasteners 82. Each end of the box headers 16 and 17 are closed, for example, by a frame member 96 (FIG. 5). Accordingly, each pass partition 18 defines a chamber, for example, chambers 84 and 86 in box header 16 and chamber 88 in box header 17. The operation of heat exchanger 10 is described below with reference to FIG. 4.

A first heat transfer fluid enters chamber 84 of box header 16 through fluid inlet 22. From the chamber 84, the first heat transfer fluid travels through the uppermost layer of glass tubes 12, in the direction of arrow 24, and into chamber 88 of box header 17. The first heat transfer fluid leaves chamber 88 via the next uppermost layer of glass tubes 12, traveling in the direction of arrow 26, and flows into chamber 86 of box header 16. The first heat transfer fluid continues to zigzag through the glass tubes 12 between the box headers 16 and 17, eventually exiting the box header 16 via the fluid outlet 28. A second heat transfer fluid is directed through the interior of the heat exchanger 10 in the direction of arrows 30. The second heat transfer fluid circulates around and over the exterior surfaces of glass tubes 12. While traveling through the heat exchanger 10, the first heat transfer fluid effectively travels in a direction opposite that of the second heat transfer fluid, indicated by arrows 30, thereby maximizing the heat transfer characteristics of the heat exchanger 10.

In a preferred embodiment of the instant invention, the first heat transfer fluid comprises a liquid, specifically water. The use of water as the first heat transfer fluid gives the heat exchanger 10 of the instant invention drastically improved heat transfer efficiency by comparison with prior art gas-to-gas glass tube heat exchangers. The use of water as the first heat transfer fluid is made possible by the tube-to-tube sheet seal 62 incorporating the sealing sleeve 40 comprising the hydraulic sealing section 42 because it will not leak even when the pressure of a liquid circulating in the box headers exceeds 50 psi. In fact, as the pressure of a liquid in the box headers increases, so does the sealing pressure exerted by the hydraulic sealing section 42 against the glass tube 12 and the tube sheet 14. In the case where the second heat transfer fluid is flue gas produced by the combustion of a fossil fuel, it is preferred that the interior sealing section 46 of the sealing sleeve 40 be a mirror image of hydraulic sealing section 42. With this configuration, the sealing sleeve 40 is operable to prevent migration of corrosive components of the second heat transfer fluid into the box headers 16 and 17. Specifically, the seals effected between the tube sheet sealing surface 52 and the tube sheet 14 and between the tube sealing surface 54 and the tube 12 prevent the migration, as by capillary action, of corrosive components of the second heat transfer fluid. As a consequence, contamination of the first heat transfer fluid by the second heat transfer fluid is prevented.

When hydraulic pressure is developed in the box headers 16 and 17, they are subjected to a great deal of force. Each pass partition 18 is subjected, with reference to FIG. 4, to a force in the direction of arrow 89 and a substantially equal and opposite force in the direction of arrow 90. The tube sheet 14, however, is subjected to a force exerted in the direction indicated by arrow 91 while the door 20 is subjected to a force exerted in the direction indicated by arrow 92. The magnitude of these forces are a direct function of the surface areas of the door 20 and the tube sheet 14. Because of the tube sheet apertures 68 (FIG. 3) in the tube sheet 14, the surface area of the tube sheet 14 is approximately half that of the door 20. Consequently, the magnitude of the force exerted in the direction indicated by arrow 92 is approximately twice the magnitude of the force exerted in the direction indicated by arrow 91. Deformation of the heat exchanger 10 which would otherwise be caused by these forces is prevented by reinforcing means which are discussed below in connection with FIG. 5, a cross section taken along the line 5—5 in FIG. 4.

The door 20 is reinforced by a plurality of ribs 93 secured thereto by welds 94. The length of the ribs 93 corresponds with the height of the door 20. The ribs 93 are sized to resist deformation of the doors 20 and of the tube sheets 14 by the forces discussed above. The tube sheet 14 is rigidly held in parallel relationship to the door 20 through the pass partitions 18 and the angle irons 79. Accordingly, the ribs 93 reinforce the tube sheet 14 as well as the door 20 so as to prevent deformation of these components by the forces exerted by hydraulic pressure in the box headers 16 and 17.

For convenience, the door 20 is secured by a hinge 95 to a frame member 96 by suitable fastening means (not shown). The hinged connection between the door 20 and the frame member 96 allows for easy access to the interior of the box header.

As shown in FIG. 5, the side panel 31 comprises a panel 100, fiber glass insulation 102, a cover panel 104 and spacer bars 106. The panel 100, the cover panel 104 and spacer bars 106 are preferably composed of a corrosion resistant material, preferably fiber glass. The panel 31 is mounted against L-shaped flanges 108 and 115 which are securely fastened to frame members 96 and 109, respectively. The flanges 108 and 115 are preferably composed of fiber glass. Between the L-shaped flanges 108 and 115, and the panel 100, there is provided a gasket 110 which is composed of a corrosion resistant material such as polytetrafluoroethylene. The panel 31 is held against the L-shaped flanges 108 and 115 by a side panel support bar 112, one end of which is securely fastened to an angled flange 114 which, in turn, is securely fastened to the frame member 96. The other end of the side panel support bar 112 is securely fastened to an angled flange 114 which, in turn, is securely fastened to the frame member 109. Thus, the side panel 31 is frictionally retained between the gasket 110 and the side panel support bar 112. Differences between the thermal expansion characteristics of the vertical frame members 96 and 109, and the panel 100 of side panel 31 will cause these components to expand and contract at different rates. The mounting arrangement discussed above for the side panel 31 accommodates these different rates of thermal expansion because it allows the side panel 31 to move relative to the gasket 110 and the side panel support bar 112. The vertical frame member 109 is a composite of U-shaped channels 116 and 117, the former composed of carbon steel for strength and the latter composed of fiber glass for corrosion resistance.

It will be appreciated, with reference to FIG. 5, that the interior I of the heat exchanger 10 is lined completely with corrosion resistant materials, namely:

1. plate 64,
2. sealing sleeves 40,
3. flange 108,
4. flange 115,
5. gasket 110
6. U-shaped channel 117, and
7. panel 100.

Thus, a heat exchanger according to one aspect of the instant invention is protected from corrosion by corrosive elements contained in a heat transfer fluid circulated through the interior thereof.

Figure 6:
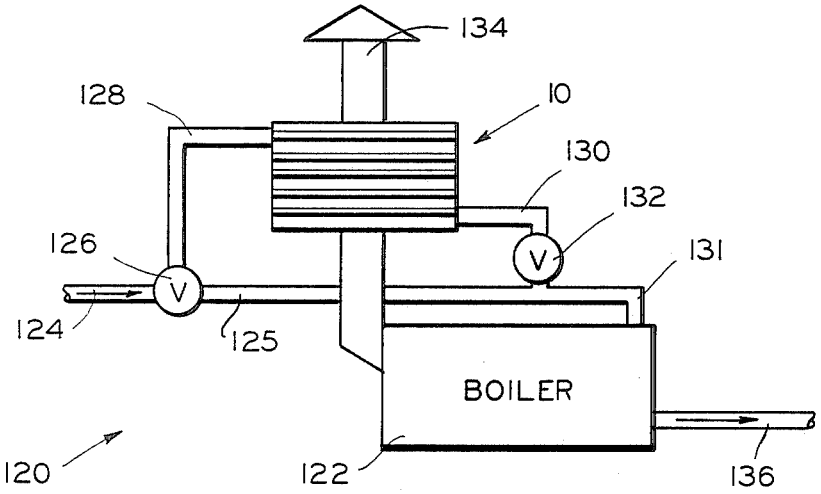
FIG. 6 is a schematic view of an installation incorporating the glass tube heat exchanger in accordance with the instant invention.

Referring now to FIG. 6, a schematic of an installation incorporating a heat exchanger 10 according to the instant invention, is indicated generally at 120. Water, on its way to a boiler 122 is circulated through a conduit 124. A three-way valve 126 is operable, in a first position, to circulate water from conduit 124 to conduit 125 and into the boiler 122. The valve 126 is operable, in a second position, to circulate water from conduit 124 to a conduit 128. When the valve 126 is in the second position, water is circulated through a conduit 128, through the heat exchanger 10, through the conduit 130, through one-way valve 132, through conduit 131 and into the boiler 122. The water is preheated in the heat exchanger 10 by flue gases leaving the boiler 122 through flue 134. The preheated water enters the boiler 122 and leaves it as steam via conduit 136. Corrosion of the heat exchanger 10 by corrosive components of the flue gas is prevented by the corrosion resistant lining discussed hereinabove with reference to FIG. 5. Periodically, the interior of the heat exchanger 10 should be washed to remove built-up residue which reduces the efficiency of the heat exchanger 10.

We claim:

1. A heat exchanger comprising, in combination, a plurality of tubes each having two ends, at least two tube sheets having two major surfaces separated by a distance of X, said tube sheets being provided with a plurality of apertures having a diameter of Z, a plurality of tubes having an outside diameter of Y, each of said tubes extending through a aperture in each of said tube sheets, a plurality of sealing sleeves each one having a longitudinal axis and being interposed between a tube sheet aperture and a portion of each tube, each of said sealing sleeves comprising a first sealing section, a second sealing section and an intermediate sealing section therebetween, wherein said first sealing section has a generally triangular cross section, one angle of which is greater than 90° when said sealing sleeve is in an unflexed condition, said angle being the closest one to said intermediate sealing section, one leg of said angle extending radially outwardly from the longitudinal axis of the sealing sleeve and in a plane which is substantially parallel to one of said tube sheets, said first sealing section incuding a planar tube sheet sealing surface, which is in contact wih one of said major surfaces of said tube sheets, said tube sheet sealing surfaces being defined by rotation of an outer portion of said one leg, about the longitudinal axis of said sealing sleeve, and wherein said intermediate sealing section has a generally cylindrically shaped sidewall and includes a portion which, in an unflexed condition, has a thickness greater than Z minus Y, said sealing sleeve being symmetric about a medial plan extending through the intermediate sealing section thereof so that said second sealing section is the mirror image of the first sealing section and wherein the first sealing section is spaced a distance of X from the second sealing section.

2. A heat exchanger as claimed in claim 1 wherein said tubes are composed of glass.

3. A heat exchanger as claimed in claim 1 or 2 and further comprising box headers on the exterior of two of the tube sheets and wherein the first sealing section of the sealing sleeve is disposed on the box header side of the two tube sheets.

4. A heat exchanger as claimed in claim 3 wherein each of said box headers comprises a fluid inlet, a fluid outlet, pass partitions, a door, and means operable to maintain each door in relatively uniformly spaced relation relative to one of said tube sheets.

5. A heat exchanger as claimed in claim 3 wherein said sealing sleeves are composed of Viton.

6. A heat exchanger as claimed in claim 3 wherein said tubes are composed of borosilicate glass.

7. A heat exchanger as claimed in claim 3 wherein the interior thereof is lined with corrosion resistant material.

8. A heat exchanger as claimed in claim 7, wherein said corrosion resistant material comprises panels mounted by mounting means so that said panels can move relative to said mounting means.

9. The heat exchanger as claimed in claim 1 wherein said intermediate sealing section further comprises a first and a secnd spaced-apart toroidal belts.

10. A heat exchanger comprising at least two tube sheets, each having opposed major surfaces and a plurality of apertures extending between said major surfaces, wherein a first major surface of each tube sheet faces inwardly towards the other tube sheet and wherein a second major surface of each tube sheet faces outwardly away from the other tube sheet, a seal having a longitudinal axis and being interposed between the edge of each tube sheet aperture and a portion of one of said glass tubes, means for circulating a first stream of fluid through said tubes, means for circulating a second stream of fluid over the outside of said tubes, wherein said seal comprises a first sealing section, a second sealing section and an intermediate sealing section therebetween, wherein said first sealing section has a generally triangular cross section, one angle of which is greater than 90° when said seal is in an unflexed condition, said angle being the closest one to said intermediate sealing section, one leg of said angle extending radially outwardly from the longitudinal axis of said seal in a plane which is substantially parallel to at least one of said tube sheets, said first sealing section including a planar tube sheet sealing surface defined by rotation of a portion of said one leg about the longitudinal axis of said seal, wherein said seal is symmetric about a medial plane extending through said intermediate sealing section so that said second sealing section is a mirror image of said first sealing section and wherein said tube sheet sealing surfaces of said first and second sealing sections engage said opposed major surfaces of said tube sheet.

11. A heat exchanger as claimed in claim 10 wherein said tubes are composed of borosilicate glass.

12. A heat exchanger as claimed in claim 11 wherein said means for circulating a first stream of fluid through said tubes comprises box headers on the outside of said tube sheets.

13. A heat exchanger as claimed in claim 12 wherein said box headers comprise a fluid inlet, a fluid outlet, pass partitions, a door, and means operable to maintain each door in relatively uniformly spaced relation relative to said tube sheets.

14. A heat exchanger as claimed in claim 13 wherein the inside thereof is lined with corrosion-resistant material.

15. A heat exchanger as claimed in claim 10 wherein said intermediate sealing section further comprises a first and a second spaced-apart toroidal belts.

* * * * *